United States Patent [19]

Chiba et al.

[11] Patent Number: 4,621,771

[45] Date of Patent: Nov. 11, 1986

[54] FLOW CONTROL NOZZLE

[75] Inventors: Yasutsune Chiba; Shizuo Arima, both of Tokyo; Katsumi Nozawa, Yokohama; Hideo Nomura, Kanagawa, all of Japan

[73] Assignee: Taisan Industrial Co., Ltd., Tokyo, Japan

[21] Appl. No.: 704,736

[22] Filed: Feb. 25, 1985

Related U.S. Application Data

[63] Continuation-in-part of Ser. No. 450,377, Dec. 16, 1982, abandoned.

[30] Foreign Application Priority Data

Feb. 16, 1982 [JP] Japan ..... 57-22116

[51] Int. Cl.[4] ..... F02M 51/06; B05B 1/30

[52] U.S. Cl. ..... 239/585; 251/129.05

[58] Field of Search ..... 239/533.3–533.9, 239/585, 101, 488–491, 585; 123/467, 590; 251/129.05, 129.14, 129.15, 129.18

[56] References Cited

U.S. PATENT DOCUMENTS

| | | | |
|---|---|---|---|
| 3,241,768 | 3/1966 | Craft | 239/585 X |
| 3,884,195 | 5/1975 | Murtin et al. | 239/585 X |
| 3,884,417 | 5/1975 | Sheffield et al. | 239/585 X |
| 4,179,069 | 12/1979 | Knapp et al. | 239/585 X |
| 4,232,830 | 11/1980 | Casey et al. | 239/585 |
| 4,247,052 | 1/1981 | Gray | 239/585 |
| 4,274,598 | 6/1981 | Wilfert et al. | 239/585 |
| 4,307,838 | 12/1981 | Martin | 239/533.4 X |
| 4,310,123 | 1/1982 | TePastte | 239/585 |
| 4,483,485 | 11/1984 | Kamiya et al. | 239/584 |

FOREIGN PATENT DOCUMENTS

| | | | |
|---|---|---|---|
| 246311 | 4/1912 | Fed. Rep. of Germany | 239/533.3 |
| 2508390 | 9/1976 | Fed. Rep. of Germany | 239/585 |
| 390667 | 4/1933 | United Kingdom | 239/533.3 |

*Primary Examiner*—Joseph F. Peters, Jr.
*Assistant Examiner*—Kevin Patrick Weldon
*Attorney, Agent, or Firm*—Kane, Dalsimer, Kane, Sullivan and Kurucz

[57] ABSTRACT

A flow control nozzle with a nozzle body arranged at one side of a joint body and a driver arranged at the other side thereof. The nozzle body comprises a nozzle chip having an orifice at the center of the front end, a cone chip with turning grooves which is in abutting engagement with the tapered face within a cavity of the nozzle chip, and a control rod fitted slidably in an axial through-hole of the cone chip and has one end adapted to close the orifice. The driver comprises an electromagnetic plunger and an electromagnetic coil. The control rod and the electromagnetic plunger are biased toward each other by springs. This nozzle permits the proportional control of the quantity of spray to be performed.

3 Claims, 5 Drawing Figures

FLOW CONTROL NOZZLE

RELATED APPLICATIONS

This is a continuation-in-part application to application Ser. No. 450,377, filed Dec. 16, 1982, now abandoned.

BACKGROUND OF THE INVENTION

This invention relates to mainly a nozzle for gun type burner to spray and burn fuel oil fed under pressure by a pump.

Such gun type burners have hitherto been generally widely used because of their good firing and quenching properties and stable quantity of combustion. However, the quantity of combustion which is different depending upon the quantity of heat required with every uses has come to be required for economy of energy. On the other hand, since the gun type burners are considerably stable in quantity of combustion because of pressure spraying type, the control of quantity of fuel oil sprayed from one and the same nozzle was extremely difficult.

The standard pressure applied for spraying fuel oil from the gun type burner is generally 7 kg f/cm$^2$ (100 PSI). Taking the case of a nozzle of 1 G pH, the quantity of fuel oil sprayed at a pressure of 7 kg f/cm$^2$ is approximately 3.78 l/H. The quantity sprayed at half the pressure is 2.6 l/H, which means that 50% change in pressure causes only 30% change in quantity of spray, and the decrease in spraying pressure resulted in coarse particles sprayed and consequently extremely worse state of combustion. Thus the control process of decreasing the pressure of fuel oil could not be used practically.

Moreover, there was the use of a return nozzle for a method of changing the quantity of combustion without changing the pressure of a pressure pump.

Such method comprising returning a portion of fuel oil under pressure from a nozzle, permits only two step change-over of the quantity of combustion and requires a proportional control valve to perform the proportional control. With use of the expensive return nozzle and proportional control valve, the system for carrying out such method became considerably expensive as a control system, and therefore had no marketability and could not continue to exist as commodities. Eventually, the control of the gun type burner has been performed depending upon ON-OFF control from an aspect of cost.

BRIEF SUMMARY OF THE INVENTION

Accordingly, it is an object of the present invention to eliminate the above-mentioned disadvantages and to provide a flow control nozzle which permits a rate of flow sprayed from the nozzle to be controlled without causing the spraying pressure of fuel oil to lower, and in addition permits the proportional control of the quantity of spray.

It is another object of the present invention to provide a flow control nozzle which is simple in construction and inexpensive to manufacture.

According to one aspect of the invention, there is provided a flow control nozzle comprising a joint body having an inlet and an axial through-hole, a nozzle chip means mounted at one end of the joint body and having an orifice at the center of the front end, a cone chip means supported in abutting engagement with a tapered face within a cavity of said nozzle chip means and having turning grooves, a control rod means supported slidably in a center through-hole of the cone chip means and at one end shaped so as to close the orifice of the nozzle chip means and at the other end biased in the direction opposite to the orifice of the nozzle chip means, a plunger case mounted at the end of the joint body opposite to the nozzle chip means, an electromagnetic plunger fitted for sliding motion in the plunger case and biased toward the control rod by a spring, and an electromagnetic coil arranged so as to enclose the periphery of the plunger case, whereby upon excitation of the electro magnetic coil, the control rod may be displaced together with the electromagnetic plunger thereby causing the change in flow resistance at the orifice portion of the nozzle chip means so that the quantity of fluid spray from the nozzle may be changed while permitting the proportional control to be performed.

Other objects and aspects of the invention will become more apparent from the following description of embodiments with reference to the accomanying drawings.

DESCRIPTION OF PREFERRED EMBODIMENT

Figure 1:
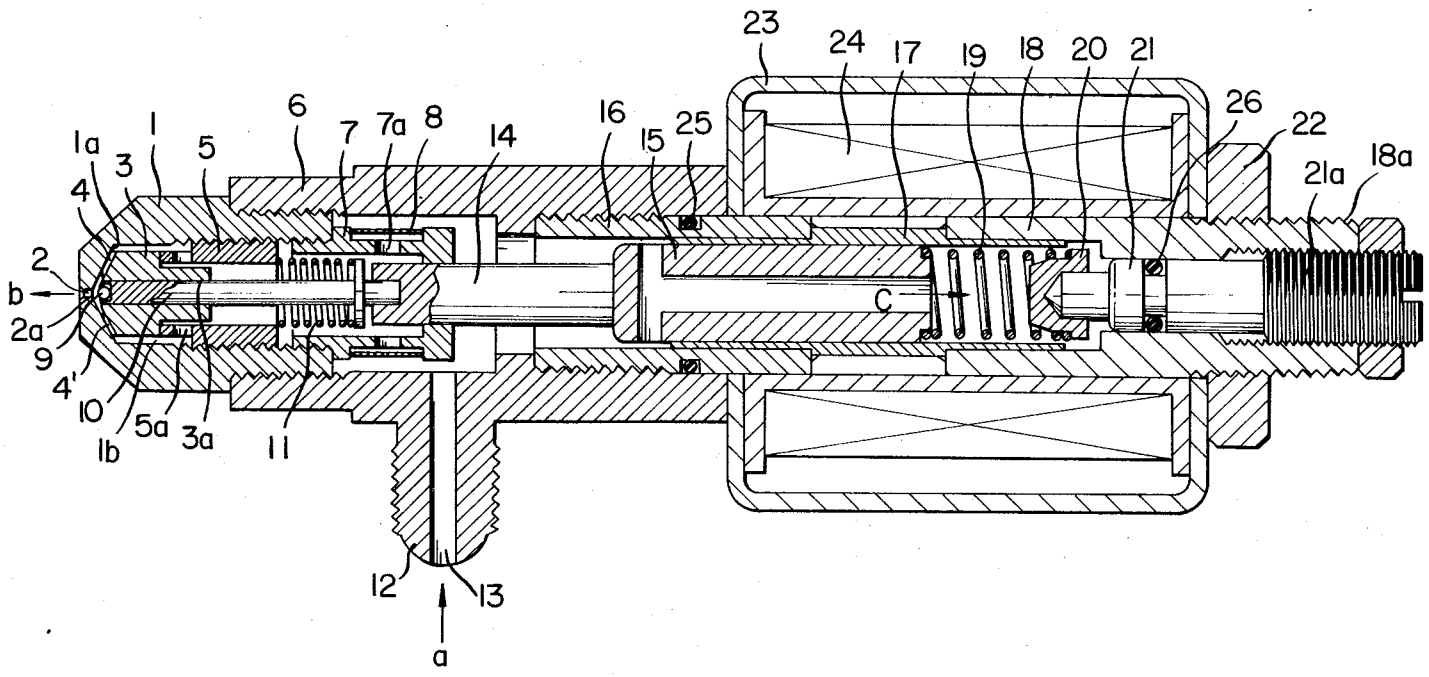
FIG. 1 is a longitudinal sectional view of one embodiment of a flow control nozzle according to the invention.

Referring to FIG. 1 which shows a flow control nozzle according to the invention, a nozzle chip 1 having at the front end thereof an orifice 2 is threadably connected at the other end to a joint body 6. A cone chip 3 with a truncated cone of head is fastened to the nozzle chip 1 by tightly screwing a chip retainer 5 into the cavity 1b of the nozzle chip 1, so that the generating surface of the truncated cone of the nozzle chip 3 is in abutting engagement with a tapered portion 1*a* in the cavity 1*b* of the nozzle chip 1. The chip retainer 5 is provided with a plurality of circular apertures 5*a* for oil passages. The cone chip 3 is formed, on the generating surface of the truncated cone, with a plurality of turning grooves 4 and 4' arranged tangentially radially. A control rod 10 is fitted for sliding motion within a longitudinal through-hole 3*a* in the center of the cone chip 3.

At the front end of the control rod 10 directed to the nozzle chip 1, a ball 9 is radially floatingly retained to thereby compensate any possible offset between the orifice 2 of the nozzle chip 1 and the control rod 10, as will be described later in detail. However, if it is possible to position quite exactly the center of the control rod 10 with respect to the orifice 2 of the nozzle chip 1 without causing any offset, the front end of the control rod 10 may be machined to either spherical surface or conical surface so that the orifice 2 may be closed with such surface.

The control rod 10 is energized in the direction opposite to the cone chip 3 by a coil spring 11 which biases the flange of the control rod 10, and presses one end of a magnetic plunger 15 through a connector 14. The magnetic plunger 15 is energized at the other end toward the nozzle chip 1 by a coil spring 19 so as to overcome the biasing force of the coil spring 11, whereby the front end of the control rod 10 closes the orifice 2 in the cavity 1*b* of the nozzle chip 1.

A tubular filter 7 having oil passages 7*a* and a filter net 8 is threadably connected to the end of the internal thread of the nozzle chip 1 concentrically with the chip retainer 5, and the connector 14 is slidably fitted in the center through-hole of the tubular filter 7.

The electromagnetic plunger 15 is slidably accommodated within a sealed portion formed by a plunger case 17 having magnetic paths 16 and 18 firmly mounted on either ends thereof. The magnetic path 16 at one end of the sealed portion is threadably connected to the joint body 6 with sealed condition kept by an O-ring 25. The magnetic path 18 at the other end of the sealed portion has in the center through-hole an adjusting rod 21 having at one side thereof a portion 21 with an O-ring 26 to seal, and at the other side a threaded portion 21*a* screwed in the internal thread of the magnetic path 18 and locked by a nut.

A spring seat 20 for the coil spring 19 is mounted on the inner end of the adjusting rod 21.

An electromagnetic coil 24 is arranged at the outside of the sealed portion, and an outer casing 23 for magnetic path and cover is mounted on the magnetic paths 16 and 18 so as to enclose the outside of the electromagnetic coil 24 and fastened to the joint body 6 by a nut 22. The joint body 6 is integrally formed with a suction joint 12 having an inlet 13.

Now, the operation of the flow control nozzle constituted as mentioned above will be explained below.

The fuel oil bed under pressure into the inlet 13 as indicated in the arrow mark "a" passes through the filter net 8, the oil passages 7*a* and the oil passages 5*a* and then to the outer periphery of the cone chip 3. Furthermore, the fuel oil under pressure flows in the turning grooves 4 and 4' of the cone chip 3 and then reaches the orifice portion 2*a* of the nozzle chip 1 which is closed by one end of the control rod 10.

When current flows through the electromagnetic coil 24, the magnetic force produced by the electromagnetic coil 24 moves the electromagnetic plunger 15 together with the control rod 10 and the connector 14 in the direction of arrow mark "c" against the biasing force of the spring 19, causing the orifice 2 of the nozle chip 1 to open, so that the fuel oil is turned by the turning grooves 4 and 4' of the cone chip 3 and sprayed in the direction of arrow mark "b".

If current flowing through the electromagnetic coil 24 is decreased to thereby weaken the magnetic force, the displacement of the control rod 10 in the direction of arrow mark "c" becomes smaller so that the fuel oil in the orifice portion 2*a* increases in flow resistance which causes less quantity of the fuel oil to be sprayed. If a plurality of flow control nozzles are arranged, all the quantity sprayed may be made equal by turning the screw 21a of the adjusting rod 21 clockwise or counterclockwise.

On the contrary, if current flowing through the electromagnetic coil 24 is increased, the displacement of the control rod 10 becomes greater so that the fuel oil in the orifice portion 2*a* decreases in flow resistances, thereby causing the quantity of the fuel oil sprayed to be increased.

However, when the fuel oil is sprayed with the control rod 10 in very close relation to the orifice 2, it causes the increase in flow resistance of the fuel oil which in turn will result in losing of the turning characteristics of spray, the reduced angle of spray and hence the extremely unfavorable combustion. Accordingly, there is naturally a restriction in the minimum quantity of combustion.

In such a case, if pulse current is flown through the electromagnetic coil 24 to thereby produce electromagnetic force intermittently, the control rod 10 is moved while repeating fine reciprocating motions, thereby making the above-mentioned flow resistance due to the control rod 10 uniform. As a result, the minimum quantity of spray may be restrained less without damaging the turning characteristics and the angle of spray, and also the control ratio of flow may be elevated, thus facilitating the proportional control to be performed.

Furthermore, when the quantity of spray of the fuel oil is automatically controlled in response to the change in a room temperature as in the case of a heating arrangement, it is possible to control the frequency of pulse current flowing through the electromagnetic coil 24 or the width of the time for pulse current flowing therethrough, or to control using jointly with both of them. Thus, a control circuit which is simple and inexpensive and having good stability can be obtained.

The electromagnetic plunger 15 and the control rod 10 in abutting engagement therewith through the connector 14 are kept in balanced and pressure engaging relationship by two springs 11 and 19, and are moved in reciprocating motion from a position of rest in the direction of arrow mark C by the intermittent electromagnetic attracting force generated by pulse current for exciting the electromagnetic coil 24, and are returned to the initial position. However as the frequency of pulse current increases, the electromagnetic plunger 15 and the control rod 10, after being moved in the direction of arrow mark C by the magnetic attracting force are not restored to the initial rest position by the biasing force of the spring 19 when the magnetic force collapses, and therefore are returned only to a position shifted slightly away from the position of rest or the position of closing the orifice in the direction of arrow C, thus being moved in micro-reciprocating motion. Consequently, since the degree of opening of the orifice 2 by the control rod 10, and also the number of times of reciprocating motion of the control rod is greater, the nozzle flow rate from the orifice 2 increases. When "on" time during duty cycle is made greater, the degree of opening and the nozzle flow rate are increased for the same reason as stated above.

In the case of lower frequency, the control rod 10 closes the orifice 2 at every reciprocating motions, and the abutting engagements of the control rod 10 with the orifice 2 at every strokes of the reciprocating motion produces chattering, which causes noise and damage. Therefore, to avoid such undesirable effects, a zone of frequency of pulse current should be determined and used. Such zone of frequency is a range of approximately 25–100 Hz. Under these conditions, the left end of the stroke of the control rod which reciprocates with the electromagnetic plunger is in a position in which a gap is provided between the orifice 2 and the rod so that any chattering caused by the abutting engagement of the end of the control rod with the nozzle chip is avoided. Thus, in the left end of the stroke the control rod is placed at a position shifted away from its rest position with the coil de-energized. As a result, the mean distance between the end of the control rod and the orifice of the nozzle chip, the mean effective area of opening, and therefore the degree of opening the orifice, and the flow resistance of fluid at the orifice can be adjusted by varying the stroke length, thereby permitting variable adjustment of the quantity of fluid sprayed from the nozzle to a desired value. When pulse current for energizing the electromagnetic coil is shut off, the end of the control rod moves to its rest position and closes the orifice of the nozzle chip. Corresponding to said frequency and "on" time during the duty cycle, the screw 21*a* of the adjusting rod 21 may be turned clockwise or counterclockwise to vary the deflection of the springs 19, 11 to thereby change the biasing force thereof, so that the quantity sprayed from the nozzle may be adjusted and also chattering may be prevented.

Figure 2:
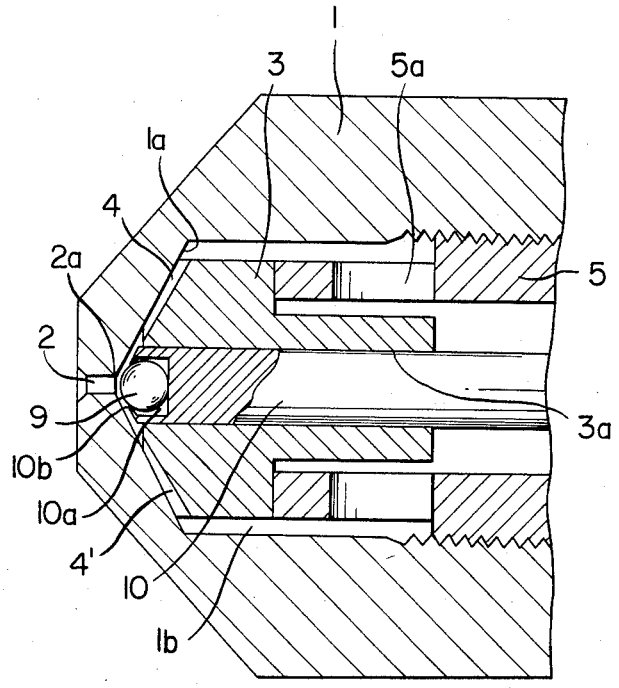
FIG. 2 is an enlarged view of the nozzle chip portion in FIG. 1.

FIG. 2 shows an enlarged view of a part of the nozzle chip.

Referring to FIG. 2, the ball 9 is loosely fitted in a ball receiving portion 10*a* at the front end of the control rod 10 so that the ball 9 is floatingly supported and held for slight displacement in the direction perpendicular to the axis of the control rod 10, and the latter is caulked at the front end to prevent the ball 9 from falling. With the orifice 2 closed, the ball 9 is at one side thereof in abutting engagement with the bottom face of the ball receiving portion 10*a* and at the opposite side with the tapered portion 1*a* in the cavity 1*b* of the nozzle chip 1, whereby the ball 9 is positioned concentrically with the orifice 2 to close the same. And it goes without saying that there exists a gap which allows the fluid to flow between the caulked portion of the front end 10*b* of the control rod 10 and the tapered portion 1a in the cavity 1*b* of the nozzle chip 1.

Since the control rod 10 is fitted in the center through-hole 3*a* of the cone chip 3 and fastened to the nozzle chip 1 by the chip retainers 5, any minute offset can occur between the center of the tapered portion 1*a* of the nozzle chip 1 and the center of the control rod 10. In such a case, unfavorable matters can occur such as the leak at the time of rest of the flow control nozzle, the distortion of an angle of spray and a pattern showing a state of distribution thereof during spraying operation.

In such a case, with the ball 9 fitted and caulked for flotation at the front end of the control rod 10 as stated above, the ball 9 displaces automatically to a position concentric with the orifice 2 a distance corresponding to the degree of offset, whereby any offset can be compensated and the positive closing and the exact spraying pattern can be expected.

Figure 3:
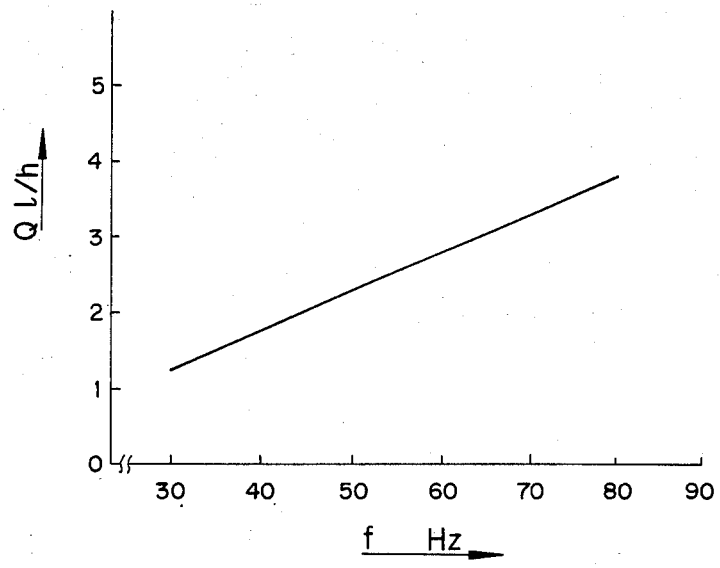
FIG. 3 is a characteristic diagram of quantity sprayed VS driving frequency of a flow control nozzle.

FIG. 3 shows a characteristic diagram of the flow control nozzle according to an embodiment of the present invention, which is plotted with the control frequency fHz taken on the axis of abscissa and the quantity Q l/H sprayed from the control nozzle taken on the axis of ordinate. The diagram having a substantial linear proportional relationship, shows how such control nozzle is easy to control.

Figure 4:
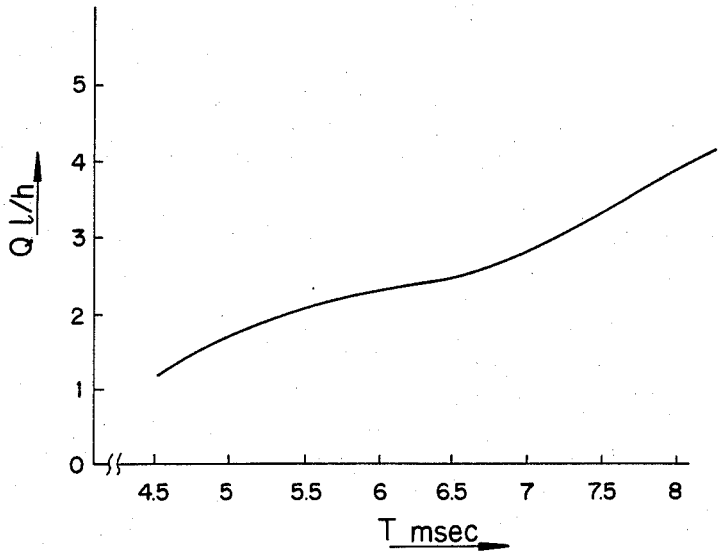
FIG. 4 is a characteristic diagram of quantity sprayed VS driving current flow time of the flow control nozzle.

FIG. 4 shows a characteristic diagram of the flow control nozzle in which the control frequency fHz on the axis of abscissa is replaced by the current flow time (width of pulse) Tmsec. The relationship between the frequency and the quantity sprayed Q l/H is the same as in FIG. 3.

Figure 5:
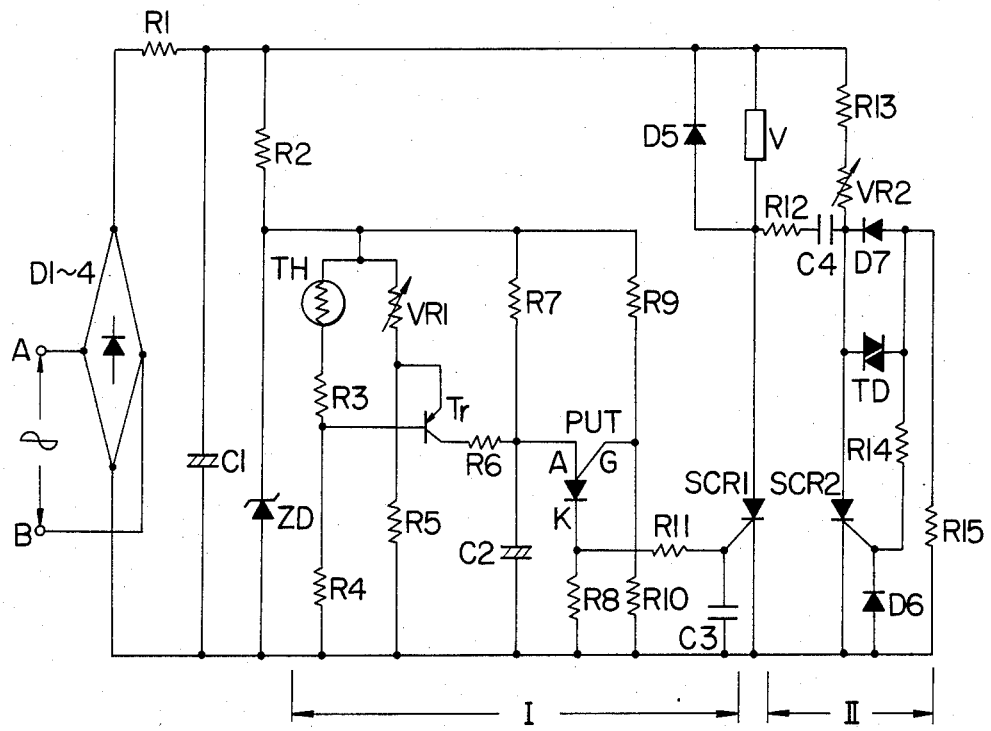
FIG. 5 is an example of a driving circuit for the flow control nozzle according to the invention.

FIG. 5 shows an example of a drive circuit for the control nozzle to perform the control of hot water using the flow control nozzle according to the present invention, which is a circuit intended to change automatically the drive frequency of the control nozzle.

The a. c. power source applied to input terminals A, B is all-wave rectified and smoothed by a bridge comprising diodes $D_1$–$D_4$, a resistor $R_1$ and a capacitor $C_1$. The electromagnetic coil V of the flow control nozzle is connected in series to a first thyrister $SCR_1$. A fixed resistor $R_{13}$ and a variable resistor $VR_2$ are connected in series to a second thyristor $SCR_2$, and all are connected in parallel to the series circuit of the above-mentioned electromagnetic coil V and first thyristor $SCR_1$.

The circuit block I at the leftside of the series circuit of the electromagnetic coil V and first thyristor $SCR_1$ is a circuit intended to control the firing angle of the first thyristor $SCR_1$ according to a set value and a detected value of temperature, and is operated by a d.c. voltage stabilized by a zener diode 2D. The variable resistor $VR_1$ and a thermistor TH in the circuit block I constitute a portion of a temperature detecting bridge. $VR_1$ performs manual temperature setting and TH performs detecting temperature in a room or hot water. The output signal in the temperature detecting bridge comprising $VR_1$, TH and every resistors is amplified to a suitable level and control the operation of a programmable unijunction transistor PUT for control of firing angle of first thyristor $SCR_1$. When the firing pulse generated with the turn-on of PUT has been applied, $SCR_1$ is conducted and current flows through the electromagnetic coil V. Upon the conduction of $SCR_1$, the charge of the capacitor $C_4$ in the circuit block II mainly comprising the second thyristor $SCR_2$ is started, and when such charge has reached a predetermined value, the trigger diode TD is turned on. With the turn-on of TD, $SCR_2$ is turned on and charge in the capacitor $C_4$ is discharged through $SCR_2$ so that $SCR_1$ is turned off. Thereafter such process is repeated.

The circuit block II is consequently a circuit intended to determine the current flow time of $SCR_1$, and the current flow time from the conduction to turn-off of $SCR_1$ may be suitably set by adjusting the required time of the capacitor $C_4$ by means of the variable resistor $VR_2$.

Further, the operation of circuit elements other than the ones specified above is obvious for those skilled in the art and the circuit constants and others are all omitted, but they will be able to be suitably selected by those skilled in the art depending upon the use and object.

Furthermore, in the control circuit, it is possible to control the charging time of the commutation capacitor $C_4$ by the variable resistor $VR_2$. This change in charging time causes the change in conduction time of the extinction thyristor, and therefore the change in turn-off time of $SCR_1$. As a result, the duration time for pulse current flowing through the electromagnetic coil is varied, and therefore the magnetic attracting force produced in the electromagnetic plunger is varied. From the relation between such varying magnetic attracting force and the biasing force of the coil spring 19, the associated control rod 10 is changed in momentum to thereby vary the degree of opening the orifice 2, so that the quantity sprayed from the nozzle may be adjusted. In addition, it is understood by those skilled in the art that various changes and modifications may be made without departing from the spirit or scope as set forth in the accompanying claims, and from the above-mentioned explanation it is also clearly possible to adjust the quantity of the fuel oil sprayed from the nozzle merely by changing a resistor value in each of the electric circuits to vary either current flow frequency or current flow time in the electromagnetic coil 24.

As mentioned above, the advantages of the present invention resides in the realization of the proportional control of the gun type burner which has hitherto been said to be impossible, and therefore the present invention will considerably benefit in general. Besides, the flow control nozzle according to the present invention may be applied to the related control between temperature and quantity of water spray in spraying humidification water.

What is claimed is:

1. A flow control nozzle comprising (1) a joint body having an inlet and an axial through-hole, a nozzle chip means mounted at one end of the joint body and having an orifice at the center of the front end, a cone chip means supported in abutting engagement with a tapered face within a cavity of said nozzle chip means and having turning grooves, (2) a control rod means supported slideably in a center through-hole of the cone chip means with a gap around the circumference of the control rod for smooth motion thereof, and at one end biased toward an electromagnetic plunger by one spring and at the other end biased towards a rest position to close the orifice of the nozzle chip means by the biasing force of another spring in the direction opposite to that biased by said one spring, (3) a plunger case mounted at the end of the joint body opposite to the nozzle chip means, the electromagnetic plunger being fitted for sliding motion in the plunger case, an electromagnetic coil arranged so as to enclose the periphery of the plunger case, and (4) an electronic control circuit which permits variable adjustment of at least one of a frequency and a duty cycle of a pulse current for exciting said electromagnetic coil, to reciprocate said control rod, with said control rod being shifted away from said rest position to form a second gap between an end of said control rod and said nozzle chip while said electromagnetic coil is energized thereby avoiding chattering, whereby said orifice has a mean effective opening adjusted to a desired value to permit variable adjustment of the quantity of fluid sprayed by the nozzle.

2. A flow control nozzle as set forth in claim 1, said electronic control circuit which permits variable adjustment of pulse current for exciting said electromagnetic coil includes a temperature adjusting element, thereby permitting the proportional control to be performed in relationship between temperature and the quantity of fuel oil sprayed from the nozzle.

3. The flow control nozzle as set forth in claim 1, wherein said control rod means is provided with a self-aligning means at the front end thereof, said self-aligning means comprising a ball receiving portion formed in the control rod at the front end thereof opposite to the orifice of the nozzle chip means and is prevented from falling off, and a ball loosely fitted in said ball receiving portion so that the ball may be slightly displaced in the direction perpendicular to the axis of the control rod means, whereby any possible minute offset between the center of the orifice of the nozzle chip means and that of the control rod means may be compensated for self-alignment of the ball thereby forming a preselected fluid spray pattern, and whereby said ball positively closes said orifice without any leaks when said coil is deactivated.

* * * * *